US009623298B2

(12) United States Patent
Ban

(10) Patent No.: US 9,623,298 B2
(45) Date of Patent: Apr. 18, 2017

(54) IRON TYPE GOLF CLUB HEAD

(71) Applicant: Bridgestone Sports Co., Ltd., Tokyo (JP)

(72) Inventor: Wataru Ban, Tokyo (JP)

(73) Assignee: BRIDGESTONE SPORTS CO., LTD., Tokyo (JP)

( * ) Notice: Subject to any disclaimer, the term of this patent is extended or adjusted under 35 U.S.C. 154(b) by 20 days.

(21) Appl. No.: 14/706,471

(22) Filed: May 7, 2015

(65) Prior Publication Data

US 2015/0343281 A1 Dec. 3, 2015

(30) Foreign Application Priority Data

May 29, 2014 (JP) ..... 2014-111381

(51) Int. Cl.

| | |
|---|---|
| ***A63B 53/04*** | (2015.01) |
| ***A63B 60/52*** | (2015.01) |
| ***A63B 60/54*** | (2015.01) |
| *A63B 71/06* | (2006.01) |

(52) U.S. Cl.

CPC ..... *A63B 53/047* (2013.01); *A63B 60/52* (2015.10); *A63B 60/54* (2015.10); *A63B 2053/0408* (2013.01); *A63B 2071/0694* (2013.01); *A63B 2209/00* (2013.01)

(58) Field of Classification Search

CPC ..... A63B 53/047; A63B 60/52; A63B 2053/0408; A63B 2071/0694; A63B 60/54; A63B 2209/00

USPC ..... 473/287–292, 324–350

See application file for complete search history.

(56) References Cited

U.S. PATENT DOCUMENTS

| | | | | |
|---|---|---|---|---|
| 4,398,965 | A * | 8/1983 | Campau | A63B 53/04 148/522 |
| 5,492,327 | A * | 2/1996 | Biafore, Jr. | A63B 53/04 473/332 |
| 6,086,485 | A * | 7/2000 | Hamada | A63B 53/04 473/329 |
| 6,368,232 | B1 * | 4/2002 | Hamada | A63B 53/04 473/329 |
| 6,592,469 | B2 * | 7/2003 | Gilbert | A63B 53/04 473/291 |
| 6,743,114 | B2 * | 6/2004 | Best | A63B 53/04 473/291 |
| 6,921,344 | B2 * | 7/2005 | Gilbert | A63B 53/047 473/334 |
| 6,991,559 | B2 * | 1/2006 | Yabu | A63B 53/04 473/332 |

(Continued)

FOREIGN PATENT DOCUMENTS

| | | |
|---|---|---|
| JP | H08-776 A | 1/1996 |
| JP | 3035480 U | 12/1996 |

(Continued)

*Primary Examiner* — Sebastiano Passaniti

(74) *Attorney, Agent, or Firm* — Muncy, Geissler, Olds & Lowe, P.C.

(57) ABSTRACT

An iron type golf club head includes a body part that is provided with a face surface and a sole surface; and a hosel part that is connected to the body part. A lower part of a back surface of the body part is an expansion part that expands rearward, a slit is disposed, which penetrates the expansion part from an upper surface to a lower surface of the expansion part, an elastic body is arranged in the vicinity of an upper part of the slit.

16 Claims, 5 Drawing Sheets

(56) References Cited

U.S. PATENT DOCUMENTS

| | | | | |
|---|---|---|---|---|
| 7,713,141 | B2 * | 5/2010 | Yamamoto | A63B 53/047 473/332 |
| 7,867,105 | B2 * | 1/2011 | Moon | A63B 53/0475 473/314 |
| 7,871,338 | B2 * | 1/2011 | Nakano | A63B 53/0475 473/332 |
| 8,157,673 | B2 * | 4/2012 | Gilbert | A63B 53/047 473/350 |
| 8,187,117 | B2 * | 5/2012 | Blumenkrantz | A63B 53/047 473/329 |
| 8,277,337 | B2 * | 10/2012 | Shimazaki | A63B 53/047 473/332 |
| 8,317,635 | B2 | 11/2012 | Gilbert et al. | |
| 9,138,622 | B1 * | 9/2015 | DeMille | A63B 53/0475 |
| 9,233,281 | B1 * | 1/2016 | Dawson | A63B 53/0475 |
| 2004/0053704 | A1 * | 3/2004 | Gilbert | A63B 53/047 473/290 |

FOREIGN PATENT DOCUMENTS

| | | | |
|---|---|---|---|
| JP | H11-178961 | A | 7/1999 |
| JP | 2002-224255 | A | 8/2002 |
| JP | 2002-253713 | A | 9/2002 |
| JP | 2004-008565 | A | 1/2004 |
| JP | 2005-058765 | A | 3/2005 |
| JP | 2013-255779 | A | 12/2013 |

* cited by examiner

IRON TYPE GOLF CLUB HEAD

CROSS REFERENCE

The present application is related to, claims priority from and incorporates by reference Japanese Patent Application No. 2014-111381, filed on May 29, 2014.

TECHNICAL FIELD

The invention relates to an iron type golf club head, specifically, to an iron type golf club head that includes an expansion part, which is made by a sole side of the head projecting rearward, and in which a slit extending the up-down direction is provided.

BACKGROUND

For golf clubs, there are iron type clubs that are used mainly for a shot on a fairway, rough, bunker etc., or a tie shot from a short hole (or par 3 hole), also there are utility clubs for play, the heads of which being similar to iron clubs in the shape.

For the iron type golf club heads, stainless steal, carbon steel, titanium, or several types of alloys are widely used to form them that are from their face part to hosel part.

The iron type golf club head has a face surface for hitting a ball and a sole surface facing the ground. A hosel part is provided at a heel side of the head. A shaft is inserted into the hosel part, being firmly bonded by a bonding means such as an adhesive agent or the like.

Regarding an iron type golf club head that has an expansion part, its gravity center is low, and a distance measured from its gravity center to a face surface (or gravity depth degree) is large. The expansion part has a shape that is formed by its sole side of the head projecting rearward.

In Patent Doc. 1, it is disclosed that a balance adjustment and weight adjustment of an iron type golf club head are achieved by providing a slit that penetrates such an expansion part from the upper surface to the lower surface. Also, at paragraph [0014] of Patent Doc. 1, it is disclosed that the slit may be entirely filled with ceramic or fiber reinforced synthetic resin.

In Patent Doc. 2, an iron head is disclosed, in which a slit (or omission part) is provided at the expansion part, the slit penetrating the expansion part in the up-down direction, and the entire slit is filled with an elastic body. By providing the omission part, even if the head hits a ball with a lower part of its face, the resilience ratio of the face becomes high and the ball hitting feeling becomes excellent.

In Patent Doc. 3, an iron head is disclosed in which a recess part is provided, the recess part subsiding from the upper surface of the expansion part, and an elastic part is filled in an inlet part (or upper part) of the recess part.

RELATED ART

Patent Doc No (1) JP Laid-Open Patent Publication: H8-776
(2) JP Laid-Open Patent Publication: 2002-253713
(3) JP Laid-Open Patent Publication: 2004-8565

By proving the slit that penetrating the expansion part in the up-down direction, several advantages are brought, such as an improvement of the resilience or a decrease of back spin amount of a golf ball. That is because the face surface is deflected when hitting the ball.

In an embodiment of Patent Document (1), the slit has a hole shape that penetrates the expansion part the up-down direction. However, the iron head having such a penetrating slit does not meet the golf club regulations. In another embodiment of Patent Document (1), the slit is filled with ceramic or fiber reinforced synthetic resin. Since those ceramic or fiber reinforced synthetic resin has high stiffness, the deflection of the face surface, which is caused by hitting a ball, is hindered by those materials. There is a possibility to deteriorate the advantage that is brought by providing the slit.

In an embodiment of Patent Document (2), since an elastic body is filled in the entire slit, the deflection of the face surface, which is caused by hitting a ball, is small. There is a possibility to reduce the above advantage that is brought by providing the slit.

In Patent Document (3), the recess part is provided on the expansion part from its upper surface side. There is no slit in the vicinity of the bottom surface of the sole part.

The present invention aims to provide an iron type golf club head that is excellent at improving the resilience of the golf club head and at a reducing effect of the back spin amount of a golf ball, further that meets the golf club regulations.

One embodiment of the present invention is to provide an iron type golf club head in which an elastic body, which is filled in a slit upper part, is prevented from falling off the head and that the head has excellent endurance.

SUMMARY

An iron type golf club head of the present invention includes a body part that is provided with a face surface and a sole surface; and a hosel part that is connected to the body part. A lower part of a back surface of the body part is an expansion part that expands rearward, a slit is disposed, which penetrates the expansion part from an upper surface to a lower surface of the expansion part, an elastic body is arranged in the vicinity of an upper part of the slit.

In one embodiment of the invention, a step part is formed at an inner rear surface of the upper part of the slit, the inner surface being at a rear surface side. The elastic body fits to the step part.

In another embodiment of the invention, a taper surface is formed at an inner rear surface of the upper part of the slit, the inner surface being at a rear surface side The elastic body fits to the taper surface.

In the invention, it is preferred that a supporting plate that is in a plate shape and is attached to the back surface of the body part, and the elastic body is arranged below the supporting plate. Further, it is preferred that an upper part of the elastic body projects upward from the upper surface of the expansion part. It is also preferred that a thickness of the supporting plate is great than that of the upper part of the elastic body.

In the iron type golf club head of the invention, it is preferred that the elastic body is arranged at a spot where a perpendicular line passes through, the perpendicular line being perpendicularly drawn from a gravity center of the body part toward the face surface, and the gravity center being determined under a condition where the elastic body is not installed to the body part.

In the iron type golf club head of the present invention, the slit penetrating the expansion part in the up-down direction is provided. Only the upper part of the slit is filled with the elastic body. Accordingly, because the most part of the slit is an empty (or cavity), the iron type golf club head has the face surface that easily deflects when hitting a ball, has an excellent resilience and decreasing effect of the back spin amount of a golf ball.

At the inner rear surface of the upper part of the slit, the step part or taper part is provided, and the elastic body fits to the step part or the taper part. Thereby, the elastic body is securely disposed. Also, the supporting plate is attached to the back surface of the face surface. By placing the elastic body below the supporting plate, the elastic body is prevented from falling off from the head.

By making the elastic body thicker than the supporting plate, the elastic body is more securely held.

The elastic body is attached to the body part without using an adhesive agent, instead by being pressed by the supporting plate. The attachment of the elastic body becomes easy.

The elastic body projects upward to some degree from the upper surface of the expansion part, making the elastic body visible from the rear view. The disposition of the elastic body is able to be confirmed directly with eyes.

The elastic body is arranged at the spot where the perpendicular line passes through, the perpendicular line being perpendicularly drawn from the gravity center of the body part toward the face surface. The gravity center is determined under the condition where the elastic body is not installed with the body part. Thereby, the elastic body is able to attached to the head without changing the gravity center height or a location of the gravity center in right-left direction.

DETAILED DESCRIPTION OF THE EMBODIMENTS

Figure 1:
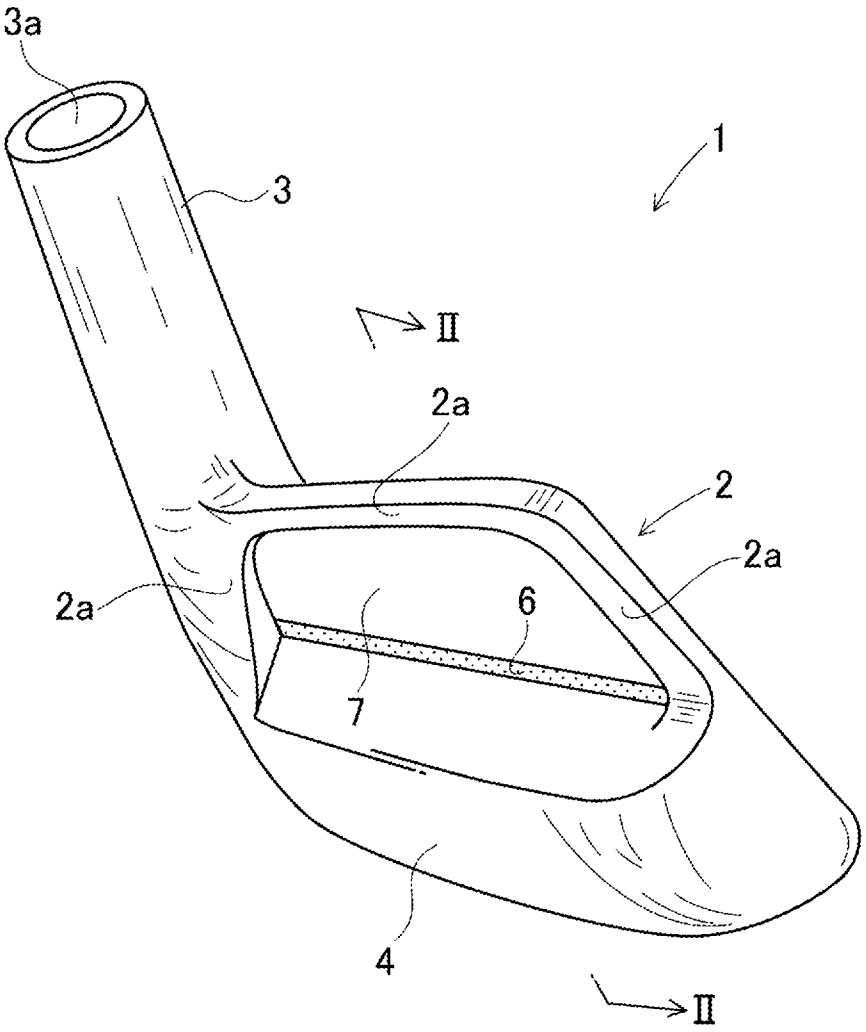
FIG. 1 is a back surface perspective view of an iron type golf club head according to an embodiment.
Figure 2:
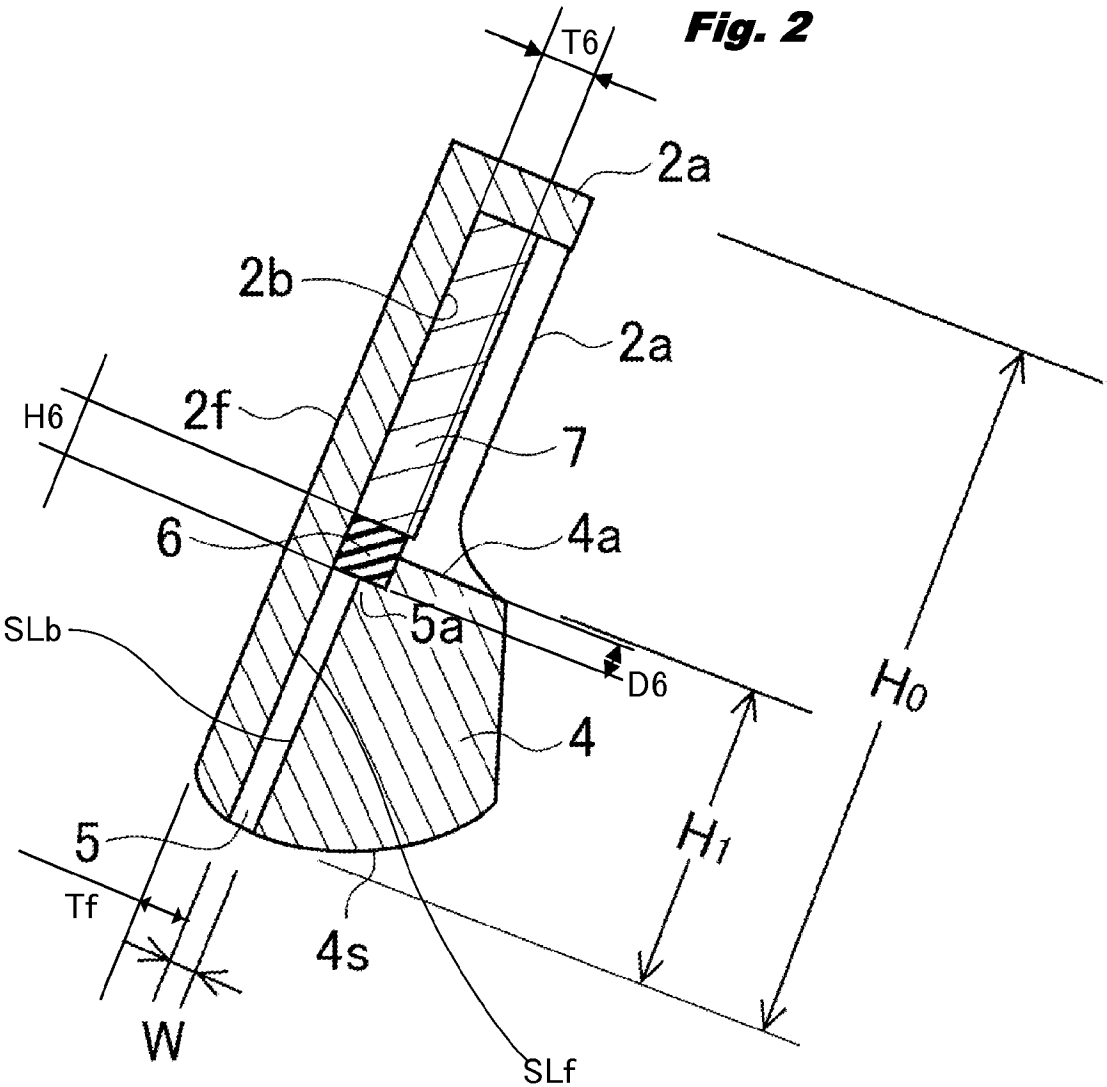
FIG. 2 is a II-II line sectional view in FIG. 1.
Figure 3:
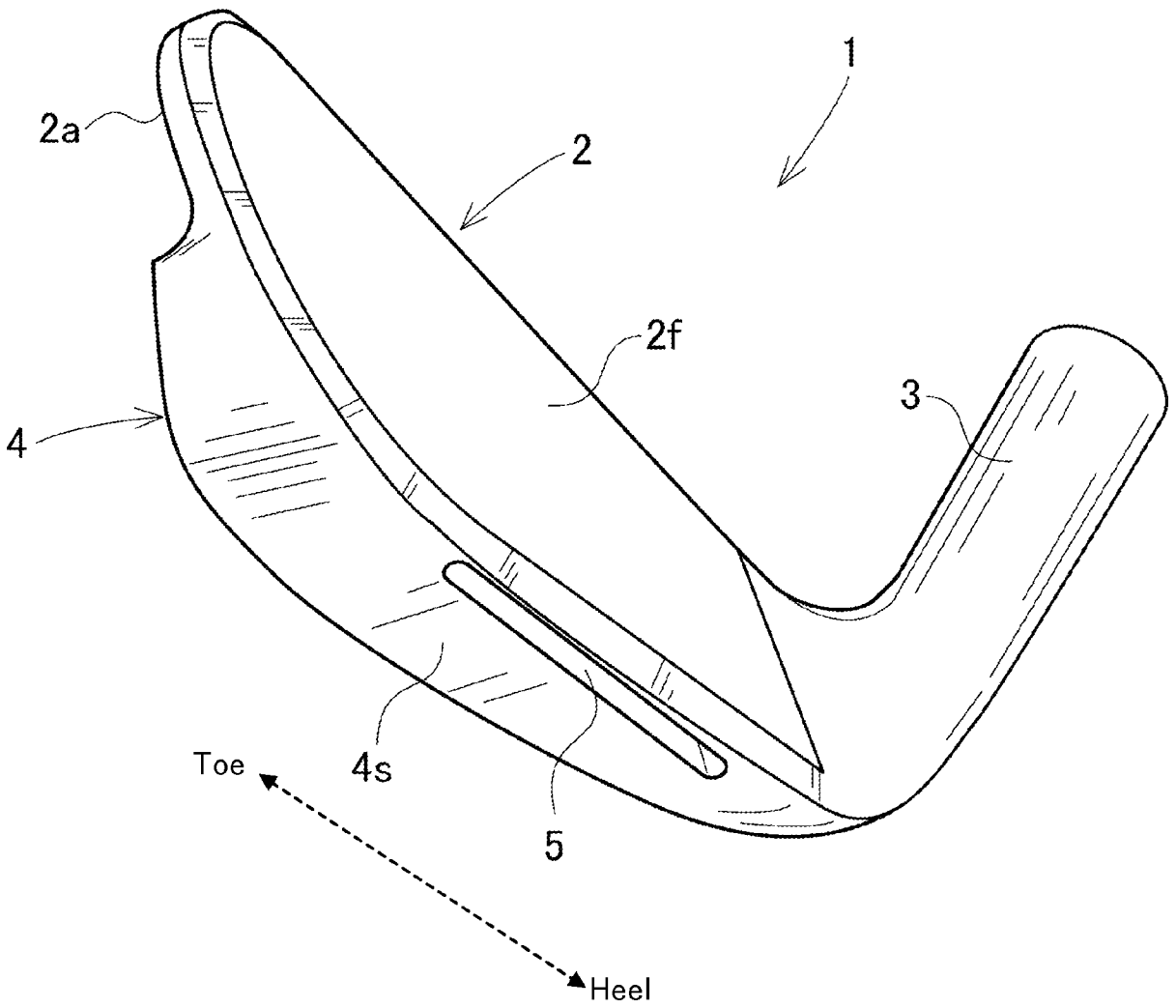
FIG. 3 is another perspective view taken from the bottom of the iron type golf club head according to the embodiment.

Referring to FIGS. 1 to 3, the first embodiment is explained.

The iron type golf club head 1 includes a body part 2, a hosel part 3 connecting to the body part 2. In the hosel part 3, a hosel hole 3*a* in which a shaft is to be inserted is provided. A front surface of the body part 2 is a face surface 2*f*, and on which multiple scoring lines (grooves not shown in the figure) are provided. The lower part of the body part 2 is an expansion part 4 that expands rearward. The body part 2 and the hosel part 3 are made of metal. Portions of them, however, may be made of non-metal materials.

Among a peripheral of back surface of the body part 2, a top side and a heel side are back fringe part 2*a* that is in a projection shape. A region surrounded by the back fringe part 2*a* forms a cavity back surface 2*b*.

The expansion part 4 extends from the toe side to the heel side of the golf club head 1. A sole surface of the expansion part is a sole surface 4*s*. A slit 5 penetrating the expansion part 5 from an upper surface 4*a* of the expansion part 4 to the sole surface 4*s* is provided. In the embodiment, the slit 5 continuously extends in the toe-heel direction by a certain length. The toe-heel direction is shown with a dot arrow line in FIG. 3. Among the inner surfaces of the slit 5, a surface SLf at the face surface 2*f* side, as shown in FIG. 2, is preferred to be flush with the cavity back surface 2*b*. The other inner surface at the rear side is donated with SLb.

An elastic body 6 is arranged on an upper part of the slit 5. In the embodiment, a step part 5*a* is formed at the upper part at the rear surface side which is one of two inner surfaces of the slit 5. The elastic body 6 fits to the step part 5*a*. The lower part of the elastic body 6 is arranged inside the slit 5. The upper part projects from the slit 5, projecting upwardly from the upper surface 4*a* of the expansion part 4. The depth by which the elastic body is inserted into the slit 5 preferably ranges from 2 mm to 14 mm (inclusive). The depth is denoted in FIG. 2 with D6.

A supporting plate 7 which is a thin plate, is attached on a back surface 2*b* with a double-stick tape, adhesive agent or gluing agent. The supporting plate 7 is placed on an entire region that is surrounded by the back fringe 2*a* and the elastic part 6. It is not necessary for the plate to cover the entire region. The supporting plate 7 works to prevent the elastic body 6 from dropping off the head by placing the supporting plate 7 at the lower portion of the supporting plate 7 in a contacting manner. By contacting the lower surface of the supporting plate 7 to the upper surface of the elastic body 6, it makes more secure to hold the elastic body 6.

In the embodiment, a thickness of the supporting plate 7, which is a length measured in a perpendicular direction from the cavity back surface 2*b*, is greater than a thickness of the elastic body 6 to some degree. Because the upper part of the elastic body 6 projects from the upper surface 4*a* of the expansion part 4, the elastic body 6 is visible from a space between a lower edge of the supporting plate 7 and the upper surface 4*a*.

In the embodiment, as shown in FIG. 2, where an entire length of the face surface is denoted as H0, which is measured in an up-down direction along the face 2*f* of the iron type golf club head 1 at a middle section in toe-heel direction and another length is denoted as H1, which is measured from a lower edge to the upper edge of the 5 (or the upper surface 4*a* of the expansion part 4) in the same direction above, the lower value of H1 is equal to or more than 20% of H0, preferably equal to or more than 20% of H0. The upper value of H1 is equal to or less than 70% of H0, preferably equal to or more than 60% of H0. Regarding a size W (or space W), which is measured in a perpendicular direction with respect to the face surface 2*f*, the lower value is equal to or more than 1 mm, preferably 2 mm. The upper value is equal to or less than 5 mm, preferably 3 mm. When the size W is too small, the hitting sound or feeling might deteriorate. When the size W is too large, it might be difficult to design such a head having a predetermined head weight. Regarding a thickness Tf of a face front surface part, which is measured between the slit 5 and the face surface 2*f*, the lower value of the thickness Tf is equal to or more than 1 mm, preferably 1.5 mm. The upper value is equal to or less than 5 mm, preferably 3 mm.

Regarding a length of the slit 5 in the toe-heel direction, the lower value is equal to or more than 20 mm, preferably 30 mm. The upper value is equal to or less than 60 mm, preferably 45 mm. The length of the slit 5 in the toe-heel direction is preferred to be uniform from the upper part to the lower part of the slit 5. It is not necessary to be uniform as long as the length is within the above ranges. For example, the upper part may be wider than the lower part. On the other hand, the lower part may be wider than the upper part.

The elastic body 6 is arranged in an entire region of the upper part of the slit 5, or is continuously provided from the heel side to the toe side of the slit 5. By forming a thickness T6 of the elastic body 6, which is measured in the perpendicular direction with respect to the face surface 2*f*, larger than the space W of the slit 5, the elastic body 6 is firmly disposed (or installed). Regarding height H6 of the elastic body 6 in a parallel direction with respect to the face surface 2*f*, the lower value is equal to or more than 3 mm, preferably 5 mm. The upper value is equal to or less than 15 mm, preferably 10 mm. When the height H6 of the elastic body is too small, the engagement with the step part 5*a* might deteriorate. When it is too large, a deflection amount of the face might decrease.

As for materials for the elastic body, materials made from rubber or resin can be available. Regarding rubber, natural rubber, polybutadiene rubber, styrene-butadiene rubber (SBR), isoprene rubber, for example, can be available. Regarding resin, ionomer resin, urethane resin, polyester resin, polyamide resin, for example, can be available. Specifically, urethane resin is preferred. Regarding Shore D hardness (D type durometer), the lower value is equal to or more than 20, preferably 40, further preferably 50. The upper value is equal to or less than 80, preferably 70. When the hardness is too small, it makes difficult to manufacture such heads. When the hardness is too large, the deflection amount of the face may be suppressed. It is preferred that the elastic body 6 fits in the step part 5*a* without using adhesive agent or gluing agent, and is held by the 2 by being supported by the supporting plate 7. When not using the adhesive agent (including gluing agent and a double stick tape) as discussed above, the disposition operation becomes simple and an influence on the head performance caused by the adhesive agent also can be nullified.

It might be practical to prepare multiple elastic bodies 6 that have different weights, and to make it possible to adjust a balance or weight of a golf club only attaching or replacing those elastic bodies. It might be practical to prepare multiple elastic bodies 6 that have different hardness thereof, and to make it possible to adjust hitting feelings or hitting sounds.

The preferred weight of the elastic body 6 ranges between 2 g and 25 g (inclusive). The weight percentage of the elastic body 6 with respect to a head to which the elastic body 6 is attached preferably ranges between 2% and 10% (inclusive).

The thickness of the supporting plate 7 may be different from the thickness of the elastic body 6. It, however, is preferred to be greater than that of the elastic body 6 so that the elastic body 6 is securely held. In such an embodiment, regarding a thickness difference between the lower part of the supporting plate 7 and the upper part of the elastic body 6, the lower value is to be equal to or more than 0.5 mm, preferably 1 mm. The upper value is to be equal to or less than 2 mm, preferably 1.5 mm. The thickness of the supporting plate 7 may be entirely uniform. A thickness of a partial portion may be different from other portions. For example, a thickness of the lower edge part of the supporting plate 7 may be larger than that of the remaining portions.

For materials of the supporting plate 7, aluminum, aluminum alloy, titan, titan alloy, resin, and materials of which specific gravities are lighter than that of the head body are available. On the supporting plate 7, logo, trademark, product number, or cosmetic design etc. are displayed.

In the golf club head 1 configured in the above way, the slit 5 is provided and the inside of the slit 5 is empty except for the upper part of the slit 5. Therewith, when the head hits a ball, the lower part of the face surface 2*f* is deflected, the resilience is improved, causing an initial speed of the golf ball to increase and the back spin amount of the golf ball to decrease. Thereby, the driving distance of the golf ball increases. The invention suits middle irons or long irons of which loft angles are smaller than that of short irons.

In the above embodiment, since the elastic body 6 projects from the upper surface 4*a* of the expansion part 4, the elastic body 6 is visible from the rear view of the iron type golf club head 1. Thereby, the elastic body 6 is visually confirmed to be installed even after the final manufacturing process of the iron type golf club head 1, making it possible to reduce manufacturing errors.

Figure 4:
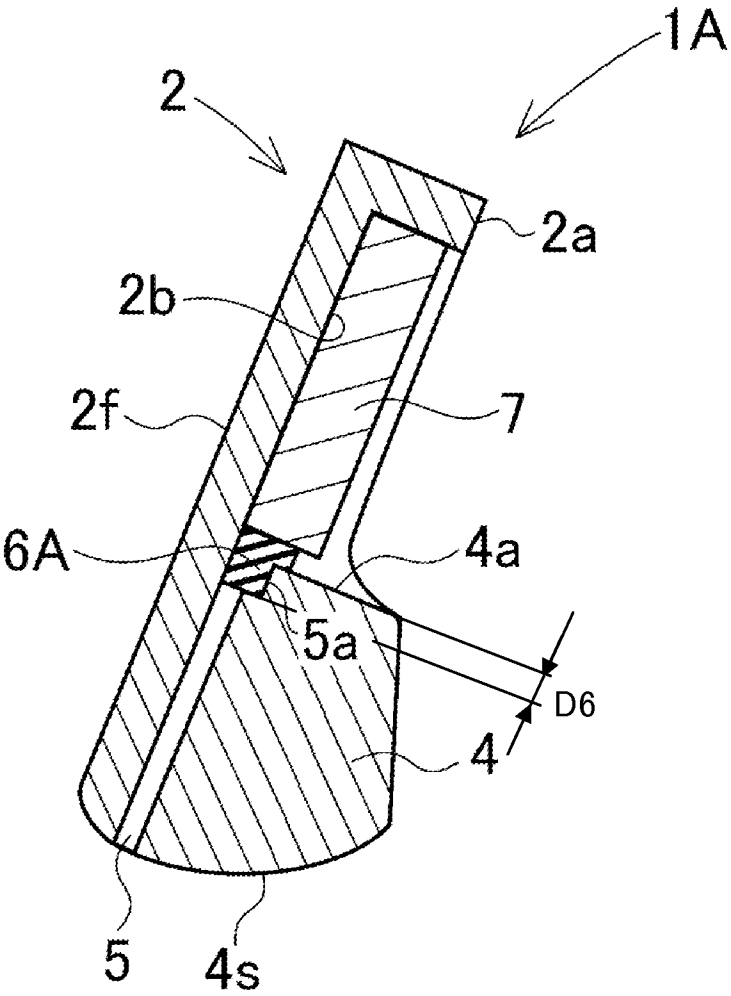
FIG. 4 is a sectional view of another embodiment.
Figure 5:
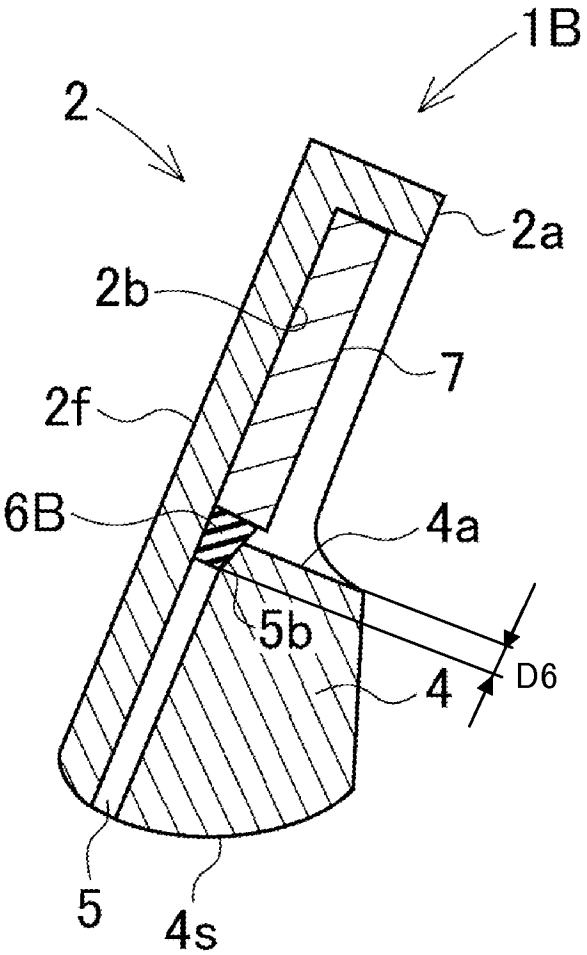
FIG. 5 is a sectional view of another embodiment.

Referring to FIGS. 4 and 5, iron type golf club heads 1A and 1B according to other embodiments are explained.

In the iron type golf club head 1 in FIG. 4, the elastic body 6A has a reverse L-letter shape in the sectional view. Its rear edge part, which is the upper part, is disposed between the upper surface of the expansion part 4 and the lower edge of the supporting plate 7. When the elastic body 6A is inserted to the upper part of the slit 5, the elastic body 6A is pressed into the slit 5 until the rear edge part contacts the upper surface 4*a* of the expansion part 4. Thereby, the elastic body 6A can be inserted inside the slit 5 exactly with a predetermined depth.

In an iron type golf club head 1B, a thickness of elastic body 6B increases as it goes up. The elastic body 6B has a taper surface at the rear surface of which the distance from the face surface 2*f* increases as its goes up. The inner rear surface of the slit 5 at the rear surface side is not a step part but a taper surface 5*b* of which the distance from the face surface 2*f* increases as it goes up. The taper surface of the elastic body 6B fits to the taper surface 5*b*. In the embodiment, the incline angle of the taper surface of the elastic body 6B corresponds to the taper surface of the inner rear surface of the slit, making it possibly to arrange the elastic body 6B along the inner rear surface of the slit.

In the iron type golf club head 1B, even if there is a small error in size or shape in the elastic body 6B or the upper part of the slit 5, the elastic body 6B is able to fit to the taper surface 5*b*, being securely held.

Other structures of the iron type golf club heads 1A and 1B in FIGS. 4 and 5 are identical to the iron type golf club head 1. The same references indicate the same parts.

In the invention, it is preferred that the elastic bodies (6, 6A, 6B) are arranged at a spot where a perpendicular line, which is defined by perpendicularly drawing from the gravity center of the body part 2 toward the face surface 2*f*, passes through. The gravity center is determined under a condition where the elastic bodies (6, 6A, 6B) have not been installed yet with the body part 2. It is further preferred that the elastic bodies (6, 6A, 6B) are arranged such that the gravity centers of the elastic bodies (6, 6A, 6B) are positioned on a perpendicular line, which is defined by perpendicularly drawing from the gravity center of the body part 2 toward the face surface 2*f*, passes through. With the constructions, the gravity center height or the position of the gravity center in right-left direction barely changes even when the elastic bodies (6, 6A, 6B) are installed. The gravity center position of the iron type golf club head is easily to be positioned at where it is designed.

In a case of a golf club set configured with multiple golf clubs having the iron type golf club heads of the present invention, each of which has a loft angle slightly different from other heads, a single type of the elastic body can be available to all of the golf clubs. On the other hand, in correspondence with numbers of the golf clubs, multiple elastic bodies having different characteristic can be installed to.

It is noted that the above disclosed embodiments are examples. The invention can be realized in other embodiments. For example, the shape or size of the expansion part 4 are not limited to what the drawings illustrate.

The iron type golf club heads (1, 1A, 1B) illustrated in the drawings have external configuration that are substantially same as the conventional iron heads. However, the invention can be applied to an iron type utility head of which an external configuration is similar to an iron head.

What is claimed is:

1. An iron type golf club head, comprising:

a body part that is provided with a face surface and a sole surface; and a hosel part that is connected to the body part, wherein a lower part of a back surface of the body part is an expansion part that expands rearward, a slit is formed, which penetrates the expansion part from an upper surface to a lower surface of the expansion part, the slit having two openings facing each other, one being an upper opening positioned on the upper surface and the other being a lower opening positioned on the sole surface, an elastic body is arranged at the upper opening of the slit such that an inside of the slit is empty below the elastic body, and a width of the upper opening in a face-back direction is greater than that of the lower opening.

2. The iron type golf club head of claim 1, wherein in a face-back sectional view of the golf club head, the slit is formed with an inner front surface and an inner rear surface facing each other, the inner front surface being closer to the face surface than the inner rear surface, and the inner rear surface being on the expansion part, a step part is formed at the inner rear surface of the upper opening of the slit, the elastic body fits to the step part.

3. The iron type golf club head of claim 2, wherein the elastic body is engaged with the step part so that the elastic body does not come out from the slit.

4. The iron type golf club head of claim 1, wherein in a face-back sectional view of the golf club head, the slit is formed with an inner front surface and an inner rear surface facing each other, the inner front surface being closer to the face surface than the inner rear surface and the inner rear surface being on the expansion part, a taper surface is formed at the inner rear surface of the upper opening of the slit, the elastic body fits to the taper surface.

5. The iron type golf club head of claim 1, wherein the elastic body is attached to the body part without using an adhesive agent.

6. The iron type golf club head of claim 1, wherein an upper part of the elastic body projects upward from the upper surface of the expansion part.

7. The iron type golf club head of claim 1, wherein the elastic body is arranged at a spot where a perpendicular line passes through, the perpendicular line being perpendicularly drawn from a gravity center of the body part toward the face surface, and the gravity center being determined under a condition where the elastic body is not installed to the body part.

8. The iron type golf club head according to claim 1, wherein a lower part of the elastic body is inserted to the upper opening of the slit so that the elastic body is disposed on the club head, and an upper part of the elastic body is not inserted to the slit, being presented above the slit and the upper surface of the expansion part.

9. The iron type golf club head of claim 8, wherein an insertion depth (D6) of the elastic body ranges between 2 mm and 14 mm.

10. The iron type golf club head of claim 1, wherein

Shore D hardness of the elastic body is equal to or more than 20 and equal to or less than 80.

11. The iron type golf club head of claim 1, wherein the elastic body has a width in a face-back direction, the width becoming larger as approaching an upper part from a lower part thereof.

12. The iron type golf club head of claim 11, wherein the elastic body entirely caps the upper opening of the slit.

13. An iron type golf club head, comprising:

a body part that is provided with a face surface and a sole surface; and a hosel part that is connected to the body part, wherein a lower part of a back surface of the body part is an expansion part that expands rearward, a slit is formed, which penetrates the expansion part from an upper surface to a lower surface of the expansion part, the slit having two openings facing each other, one being an upper opening positioned on the upper surface and the other being a lower opening positioned on the sole surface, an elastic body is arranged at the upper opening of the slit such that an inside of the slit is empty below the elastic body, the iron type golf club head further comprises a supporting plate that has a substantially uniform thickness in a top-sole direction and is attached to the back surface of the body part, and the elastic body is arranged below the supporting plate.

14. The iron type golf club head of claim 13, wherein the thickness of the supporting plate is greater than that of the upper part of the elastic body.

15. An iron type golf club head, comprising:

a body part that is provided with a face surface and a sole surface; and a hosel part that is connected to the body part, wherein a lower part of a back surface of the body part is an expansion part that expands rearward, a slit is formed, which penetrates the expansion part from an upper surface to a lower surface of the expansion part, the slit having two openings facing each other, one being an upper opening positioned on the upper surface and the other being a lower opening positioned on the sole surface, an elastic body is arranged at the upper opening of the slit such that an inside of the slit is empty below the elastic body, the iron type golf club head further comprises a supporting plate that is arranged on an upper part of the back surface, and a lower edge of the supporting plate presses down an upper part of the elastic body so that the supporting plate prevents the elastic body from dropping off from the club head.

16. The iron type golf club head of claim 15, wherein the upper part of the back surface is surrounded with a back fringe and the expansion part, the back fringe projecting rearward from the body part, and the supporting plate extends up to the back fringe in a top-sole direction.

* * * * *